United States Patent [19]

Brokmann et al.

[11] 4,280,548

[45] Jul. 28, 1981

[54] FURNITURE SUCH AS CHAIRS AND COUCHES

[76] Inventors: Manfred Brokmann, Silcherstr.5; Kurt Sanders, Friedrichstr.29; Dieter Sanders, Haneschweg 2; Hermann Westhoff, Augustenburgerstr. 85a, all of Osnabrück, Fed. Rep. of Germany

[21] Appl. No.: 940,503

[22] Filed: Sep. 7, 1978

[30] Foreign Application Priority Data

Sep. 23, 1977 [DE] Fed. Rep. of Germany ..... 2742842
Dec. 9, 1977 [DE] Fed. Rep. of Germany ..... 2754872
May 8, 1978 [DE] Fed. Rep. of Germany ..... 2820012

[51] Int. Cl.[3] ..... A47H 13/00

[52] U.S. Cl. ..... 160/383; 160/402; 160/DIG. 15

[58] Field of Search ..... 160/87, 327, 371, 383, 160/392, 395, DIG. 15, 402; 24/16 PB, 182, 197, 200, 265 C, 265 H, 265 AL; 297/441, 452

[56] References Cited

U.S. PATENT DOCUMENTS

| | | | |
|---|---|---|---|
| 2,737,232 | 3/1956 | Gruber | 160/DIG. 15 |
| 3,088,517 | 5/1963 | Schwartz et al. | 160/383 |
| 3,092,176 | 6/1963 | Kramer | 160/DIG. 15 |
| 3,375,861 | 4/1968 | Marlow | 160/371 |
| 3,654,669 | 4/1972 | Fulton | 24/16 PB |

FOREIGN PATENT DOCUMENTS

| | | | |
|---|---|---|---|
| 333129 | 11/1958 | Switzerland | 160/DIG. 15 |

*Primary Examiner*—Peter M. Caun

[57] ABSTRACT

A support for furniture, such as outdoor furniture, has a support frame and stretched thereon is a net or lattice-like arrangement of flat web strips of plastics material; where they cross one another the strips are bonded together by means of thin planar enveloping members. The webs extend between and are secured to opposite sides of the frame, and to each end of each web a securing member is attached; each web is secured to an associated side of the frame by looping its end around the side and fastening the end by means of slipping the securing member onto the strip itself in the vicinity of the frame. Several forms of securing member are disclosed, and in each case the member is slotted or U-shaped enabling the member to be slipped transversely onto the strip. Each member has means to prevent the securing member inadvertently slipping transversely off the strip.

16 Claims, 26 Drawing Figures

Fig.6
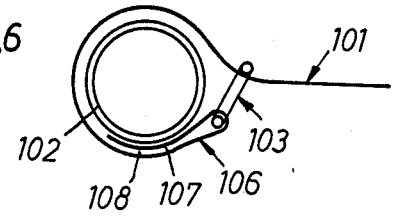
Fig.7
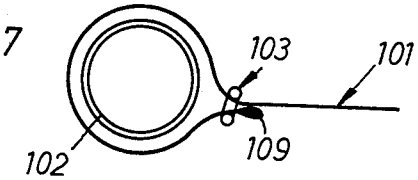
Fig.8
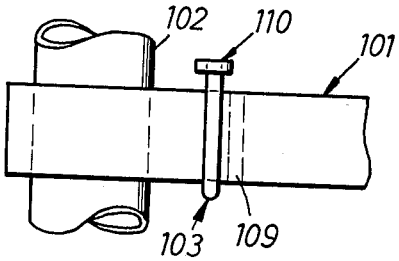
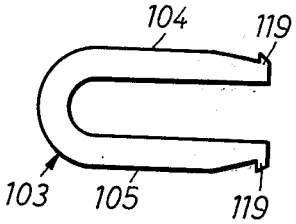
Fig.19
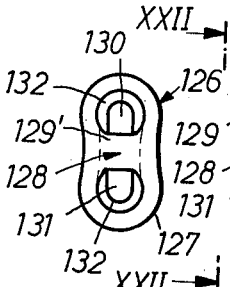
Fig.20
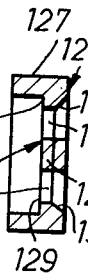
Fig.21
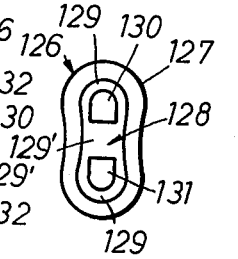
Fig.22

104
111
113
112
103
105
104
103
113
105

XII
115

104
114
103
XII
105
114

105

104
119
103
105
119
XV
118
116
132
117
132
118
XV 132
116
120
122
117
121
132

104
XVIII
124
132
123
132
103
105
XVIII
125

132
123
124
132
125

FURNITURE SUCH AS CHAIRS AND COUCHES

BACKGROUND OF THE INVENTION

The present invention relates to improvements for furniture such as chairs and couches.

More particularly, the invention relates to a net-like or lattice-like support for furniture for sitting or lying on, consisting of strips extending parallel to one another in the longitudinal and/or transverse direction, the strips having attachment means for connecting their free ends to a frame of a piece of furniture.

In known supports of this kind, the strips are cords which are connected to one another at their points of intersection by a steel clip or the like and have hooks at their free ends made of metal wire which are inserted into holes in the frame. Instead of steel clips, it is also known to connect the cords at their points of intersection by means of coated plastics members.

Such supports have proved their worth in practice, but require holes to be made in the frame. The presence of holes weakens the frame and can encourage the onset of corrosion. The wire hooks at the ends of the cords can also corrode. Moreover, furniture embodying such supports can prove noisy when a person sitting or lying on the furniture moves.

SUMMARY OF THE INVENTION

Here the invention provides a remedy in that each strip is formed by a flat strip, known per se, and the end of the strip is taken round a frame strut, forming a loop, and thereafter is secured back to the strip itself. The strips preferably consist of extruded and stretched plastics material.

According to one aspect of the present invention there is provided a net-like or lattice-like support for furniture intended to be sat, reclined or lain upon, consisting of two arrays of strips extending in two intersecting directions and attachments for securing the free ends of the strips to the frame of a piece of furniture, each strips being in the form of a flat strip connectable to a part of the frame by passing an end of the strip around the same frame part to form a frame-encircling loop and securing the said end to the strip itself by means of a securing member adapted to grasp the strip and constituting one of the said attachments.

The invention also provides a support for furniture intended to be sat, lain or reclined upon, comprising a frame and a net- or lattice-like filamentary cover stretched upon the frame, the filamentary cover comprising two arrays of filaments which extend in two intersecting directions across the frame, the filaments being in the form of flat strips, and the strips being connected to the frame by means of frame-encircling looped ends of the strips, strip ends forming the encircling loops each being fastened, by a searing member mounted on and grasping the associated strip adjacent the frame, to a portion of the strip which extends across the frame away from the encircling loop.

The net or lattice-like support according to the invention is particularly economical to produce and can offer a comparatively large supporting area for upholstery. In fact, upholstery is not essential and the lattice-like support can well be used alone, especially for outdoor furniture. The support is effectively silent even under alternating loads imposed thereon in use. Its spring or resiliency characteristics can be preselected by suitable choice of the dimensions of the strips.

The frame itself needs no attachment holes so that weakening of the frame and the risk of onset of corrosion associated with holes is avoided. Fitting the support strips to the frame can be accomplished extremely quickly and easily and looping the strips round the frame ensures a firm anchoring which has the benefit that it increases under load.

The securing members fitted to the filaments can each consist of a hooked plate construction which is particularly suitable for relatively narrow strips, and is very economical and easy to handle.

Another form of securing member comprises a substantially U-shaped clip which can be slid laterally over the strip and over the end thereof looped round the frame, the clip being furnished with means to guard against the strip being pulled laterally out from between the free ends of the opposed arms of the clip.

Such a securing member renders it possible to pass the ends of the strips round the frame, to align the ends with the remainder of their strips and thereafter to fix the ends back to the strips themselves merely by pushing the clip over the strip, fitting of the securing means preventing accidental detachment of the clip.

Advantageously, other securing members feature a clasp. Once the securing member is placed astride the strip and its end looped round the frame, a transverse pin or equivalent transverse locking member is applied to the securing member to guard against the strip held by the securing member inadvertently slipping laterally therefrom.

With a U-shaped clip and such a clasp, fastening of the strip looped round the frame becomes an extremely rapid operation accomplishable with a single movement of the hand, as well as considerably shortening and simplifying the production of a complete frame covering. In the fitted position, the clasp assumes a position aligned transversely to the longitudinal direction of the strip and so is parallel to the adjacent portion of the frame. The arrangement has a favourable appearance while at the same time the simplicity of the securing member itself reduces the production costs.

BRIEF DESCRIPTION OF THE DRAWINGS

Embodiments of the present invention will now be described in details by way of example only with reference to the accompanying drawings in which:

FIG. 6 is a diagrammatic side end view of a frame member of a piece of furniture with an end of a strip element of a frame covering secured to the strut in another way according to the invention, FIG. 7 is a similar view to FIG. 6 of a further modification according to the invention, FIG. 8 is a fragmentary plan view of the embodiment of FIG. 7, FIGS. 9 and 10 show two views of a clip useful in practising the invention, FIG. 19 is a view similar to FIG. 16 of a fifth clip useful in practising the invention, FIG. 20 is a plan view of an end cap for the clip of FIG. 19, FIG. 21 is a section through the cap of FIG. 20, FIG. 22 is a view of the cap along the arrows XXII—XXII in FIG. 21.

DETAILED DESCRIPTION

Figure 1:
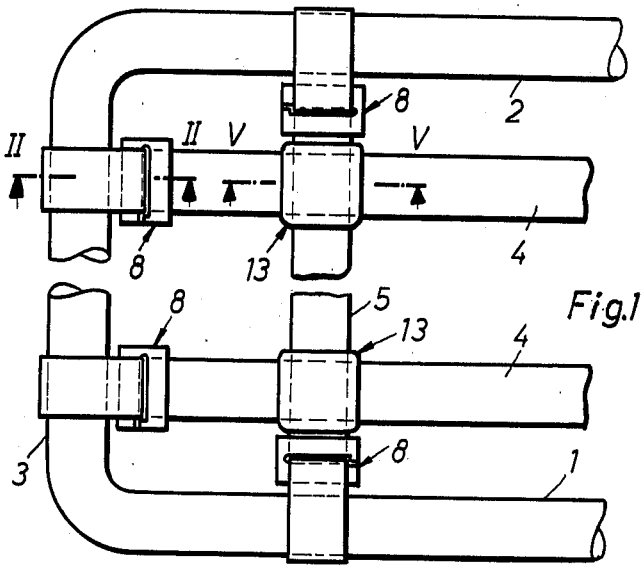
FIG. 1 is a fragmentary diagrammatic plan view of the frame of a piece of furniture with a frame covering embodying the invention.
Figure 2:
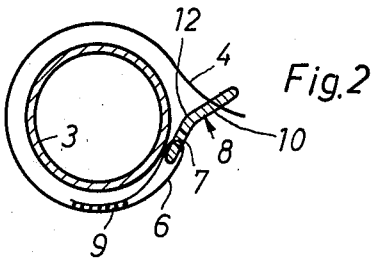
FIG. 2 is a section on the line II—II.
Figure 3:
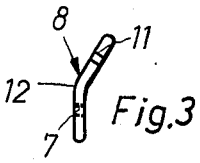
FIG. 3 is a side view of the hook illustrated in FIG. 2.
Figure 4:
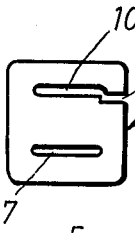
FIG. 4 is a front view of a hook used to secure a frame covering element to the frame.
Figure 5:
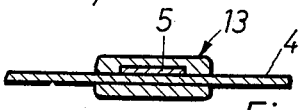
FIG. 5 is a section on the line V—V in FIG. 1.

In FIG. 1, the sides 1, 2 and 3 of a frame of a piece of furniture for sitting or lying on in the illustrated example are formed by a tube which is circular in cross-section. Such tubular frames are frequently used inter alia in garden and clamping furniture. The frame covering consists of a lattice of strips 4 and 5 respectively extending longitudinally and transversely across the frame. The number of strips, 4, 5 and their spacing apart can be chosen at will to suit the particular item of furniture. The longitudinal strips 4 are aligned parallel to one another, the transverse strips 5 likewise, and strips 4 and 5 cross at right angles in the illustrated arrangement. However, if for example the longitudinally directed frame struts 1, 2 diverge or converge, the strips may not cross each other at right angles and strips 4 may not be parallel with one another.

The strips 4, 5 consist of tensioned, extruded plastics material and have a tensile strength of preferably 150 kp or more. In the embodiment shown in FIGS. 1 to 5, their preferred width amounts to about 10 to 15 mm with a thickness of about 0.4 to 1.5 mm. These dimensions are associated with the required tensile strength and with the plastics material chosen, which may be high-pressure or low-pressure polyethylene, polypropylene, polyester or polyamide. For reasons of cost and satisfactory weldability with the use of heat, polyethylene is advantageous and it is also economical, but on the other hand it has a low strength. From the point of view of strength, polyamide and polyester are advantageous, and as a result of their high strength the required tensile strength can be obtained with smaller cross-sectional dimensions, but on the other hand they are expensive materials. Furthermore, a certain spring characteristic, that is to say a certain resilience, is important which should not lead to plastic deformation in the sense of extension with the tensile stress provided.

At their free ends, the strips 4, 5 are bent over to form holding loops 6. Before the holding loops 6 are closed, the ends of each strip is threaded through a receiving slot 7 in a thin plate 8 which forms a hook. With the aid of the plates 8, the ends of the strips can be anchored to the frame sides 1, 2, 3. The closing of the holding loop 6 is effected at 9 by adhesion or welding of the superimposed strip regions, thereby fastening the hook plate 8 to the strip.

Apart from the closed receiving slot 7, which is aligned transversely to the longitudinal direction of the strip, the hook plate 8 comprises a hook slot 10 parallel to slot 7. Slot 10 opens to one side of the plate 8. At its end open towards the side, the hook slot 10 has an introductory region 11 set back or offset towards the receiving slot 7. The offset configuration prevents a strip from accidentally sliding transversely out of the hook slot 10 after the end of the strip has been taken round one of the sides 1, 2, 3 and the strip has been inserted into the hook slot 10. The slots 7, 10 have widths and lengths closely matching the thickness and width of the strip. As can be seen from FIGS. 2 and 3, the plate 8 is bent slightly about a transverse line 12 situated in the region between the slots 7, 10, in order to ensure a substantially right-angled alignment of the plate in the region of its slot 10 in relation to the strip 4 or 5 engaging through this slot after the suspension. The hook plates are made either of metal or of a high-strength plastics material, and the boundary edges of the slots 7, 10 are rounded to prevent cutting into the associated strips.

The strips 4, 5 may consist of the same material and have the same cross-sectional dimensions. Strips 5 extending transversely generally have to take up higher loads, and accordingly they may consist of a material differing from the material of the strips 4 or have different dimensions.

The strips 4, 5 are connected to one another at their points of intersection. Each connection is provided by a flat envelope member 13 which surrounds the strips 4, 5 and is stuck or fused to the strips at its faces adjacent to the strips. Connection can be brought about particularly easily if, as in a preferred manner, the envelope member is in the form of a plastics injection-moulded member embedding the strips at the point of intersection and the material of which fuses superficially with the plastics strips when they are coated with it. Such a connection is of particular advantage because it does not adversely affect the tensile strengths of the strips where they cross. The connection between the strips and the envelope member 13 is favoured by a roughening of those parts of the surfaces of the strips which come into contact with the envelope member to be injection-moulded round them. The same plastics material may be used for the envelope member as was selected for the strips. The flat envelope member which barely exceeds the dimensions of the strips, does not have a disturbing effect either with regard to superimposed upholstery or when the frame covering is intended to be sat or reclined upon directly by the user. The fitting of the covering to the frame struts 1, 2, 3 merely requires the ends of the strips provided with the hook plates 8 to be passed round the appropriate frame struts, each strip thereafter simply being inserted laterally into the hook slots 10 of the hook plates 8 at its opposite ends. Under the initial tension provided during the fitting and reinforced by the tension of the strips 4, 5 during use, the covering is firmly seated on the frame. The sides 1, 2, 3 no longer requires any holes for use in anchoring the covering thereto. The covering lattice can advantageously be prefabricated to suit the size of the frame.

The frame covering in a second embodiment which is illustrated in FIGS. 6 and 22 consists of flat strips 101. Strips 101 extend parallel to one another and can be fastened at their two ends, of which only the left-hand end of a strip is illustrated in each of the FIGS. 6 to 8, to the frame sides 102 of the frame of a piece of furniture by passing their ends around sides 102 and then securing their ends back on themselves by means of a separate securing member.

The securing member comprises a clip 103 which is bent substantially into a U-shape, preferably from round steel wire, and has two arms 104, 105 parallel to one another. This basic shape of the clip is common to all the clip constructions described in more detail below.

The clip 103 can be slid, as a separate connecting element, laterally over the strip 101 and over its end passed round the side 102 to secure the end of the strip back upon the strip, as can be seen from FIGS. 6 to 8. If a tension or holding loop 106 has been formed at the end of the strip 101 as shown in FIG. 6, for example by bending over the end strip portion 107 and welding at 108 to the adjacent strip region, then, as illustrated in FIG. 6, a clip 103 can be used in which the spacing of the U-arms 104, 105 corresponds to a multiple of the thickness of the strip 101. With this arrangement, the end of strip 101 cannot be detached from clip 103 by a pull lengthwise of the strip.

On the other hand, if a transverse thickened portion 109, for example a melted bead, an extruded-on rib or the like, is provided at the end of the strip 101, then a clip 103 can be used wherein the spacing of the U-arms is less than the combined thickness dimension of the transverse thickening 109 and the thickness of the strip 101. In this case, the transverse thickened portion prevents the end of the strip from pulling out of the clip 103, and no end loop is required.

Each clip 103 further includes securing means which is indicated diagrammatically in FIG. 8 at 110. The securing means is located in the region of the free ends of arms 104, 105 and serves to prevent the strip 101 slipping laterally from the clip 103.

Figures 9, 10, 11, 12, 13, 14, 15, 16, 17, 18:
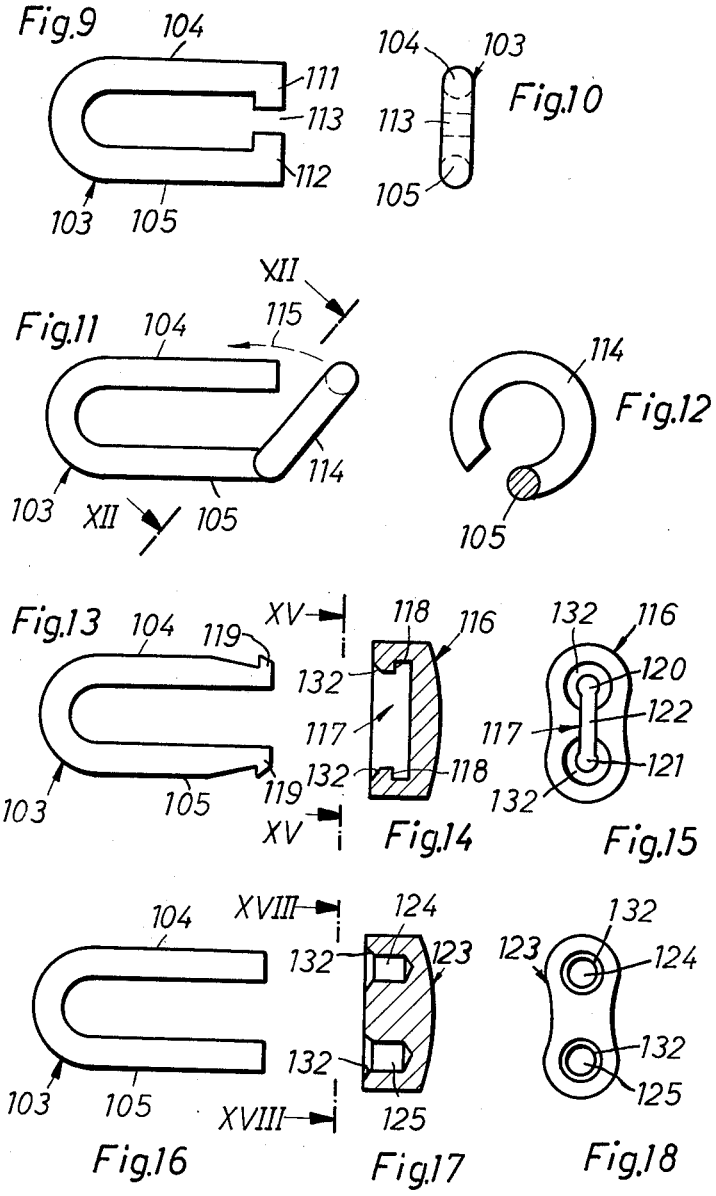
FIG. 11 is a view similar to FIG. 9 of another clip useful in practising the invention.
FIG. 12 is a section on the line XII—XII of FIG. 11.
FIG. 13 is a view similar to FIGS. 9 and 11 of a third clip useful in practising the invention.
FIG. 14 is a section through an end cap for the clip of FIG. 13.
FIG. 15 is a view in the direction of the arrows XV—XV in FIG. 14.
FIG. 16 is a view similar to FIG. 13 of a fourth clip useful in practising the invention.
FIG. 17 is a section similar to FIG. 14 through an end cap for the clip shown in FIG. 16.
FIG. 18 is a view of the cap in the direction of the arrows XVIII—XVIII in FIG. 17.
Figure 24:
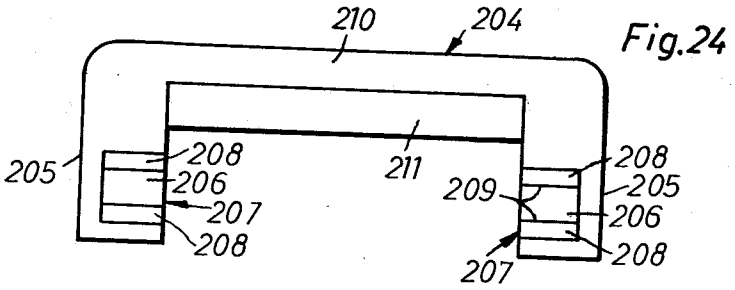
FIG. 24 is a front view of a clasp.

In the form shown in FIGS. 9 and 10, the securing means 110 is formed by oppositely inwardly bent end portions 111, 112 at the ends of the U-arms 104, 105 of the clip, the end faces of which define between them an entry gap 113 reduced in width in comparison with the spacing of the U-arms. Accordingly, the end portions 111, 112 present inwardly-facing shoulders which effectively prevent accidental detachment of clip 103 from the strip 101 or from its end loop 106, where such a loop is provided.

In the form shown in FIGS. 11 and 12, the securing means 110 consists of an eye 114 formed at the end of the U-arm 105, which, initially as illustrated in FIG. 11 lies in a plane inclined to a transverse plane to the U-arms 104, 105. Eye 114 can be displaced e.g. bent in the direction of the arrow 115, about the junction between the eye 114 and the U-arm 105, into a securing position in which it engages with a locking action round the end of U-arm 104. In its operative, securing position, eye 114 clasps arm 114 to arm 105 and provides security against the arms bending under tensile loading of the strip 101, even if the forces acting in a bending sense on the clip 103 considerably exceed the bending resistance of the connecting region between the arms.

In the form shown in FIG. 13, the securing means 110 comprises an end cap 116 which can be fastened with a locking action on the free ends of the U-arms 104, 105. The end cap 116 is also shown in detail in FIGS. 14 and 15 and is conveniently a plastics injection-moulded part. The cap has a coherent inner recess 117 to receive the ends of the clip, which recess has locking shoulders 118 for locking engagement behind locking extensions 119 on the ends of the clip. The recess 117 is formed by two receiving pockets 120, 121 for the ends of the clip, a connecting slot 122 extending between the pockets. With this construction it is possible by pressing the ends of the clip together to remove the end cap from clip 103 in order to release the clip from the strip. Connecting slot 122 could be omitted in which case removal of end cap 116 is only possible by destroying it.

In the form shown in FIG. 16, clip 103 has U-arms 104, 105 with smooth or square ends. The associated end cap 123 illustrated in FIGS. 17 and 18 is again most conveniently a plastics injection-moulded part and has two blind holes 124, 125 which are tapered towards their bottoms, that is to say towards the right in FIG. 17. If such a cap 123 is pushed over the ends of the clip, then the ends of the clip become anchored in the blind holes 124, 125 by jamming, which is caused by expansion of the blind holes 124,125 on penetration of the ends of the clip.

The clip 103 illustrated in FIG. 19 corresponds to that shown in FIG. 13. Instead of the cap 116 as shown in FIGS. 14 and 15, however, here an end cap 126 is provided as a securing means 110 which can be injection-moulded from plastics material with a particularly simple injection-mould. This end cap 126 comprises an outer wall 127 which in use enshrouds the ends of the clip and a transverse inner wall 128 which is perpendicular to the U-arms 104, 105 of the clip 103. Wall 128 has an aperture formed therein to receive the ends of the clip. The transverse inner wall 128 forms a locking shoulder 129 to be engaged behind by the locking extensions 119 at its outside seen in the fitted position of the end cap 126. The outer wall 127 of the end cap 126 when fitted to the clip projects beyond the ends of the clip 103 the latter accordingly being countersunk and hidden from sight when viewed in the peripheral direction.

The aperture is divided by a transverse web 129' into two partial apertures 130, 131 each receiving one end of the clip, and web 129' connects the opposite side regions of the outer wall 127. This transverse web can be omitted, however, if release of the cap from the clip is desired by pressing the U-arms of the clip together.

The end caps 116, 123 and 126 each comprise, in the region of their internal recess 117 of their blind holes 124, 125 or their apertures 130, 131, at the side from which the ends of the clip enter when the cap is fitted, chamfered surfaces 132 which form a more or less funnel-shaped entry for the ends of the clip and facilitate their sliding into the end caps as they are fitted.

Figure 25:
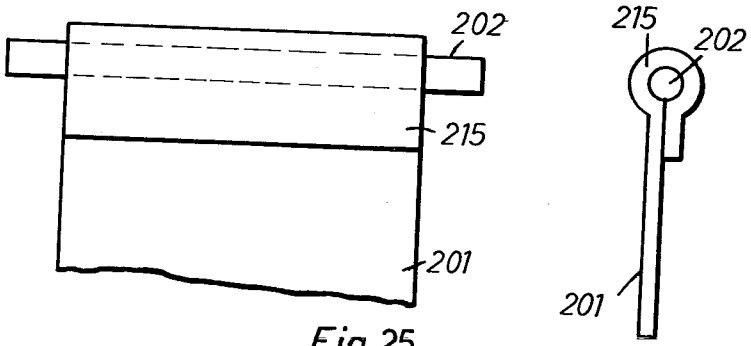
FIG. 25 is a front view of the end of a strip element of the frame covering provided with a transverse pin.
Figure 26:
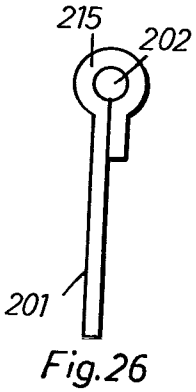
FIG. 26 is a side view of the arrangement shown in FIG. 25.
Figure 23:
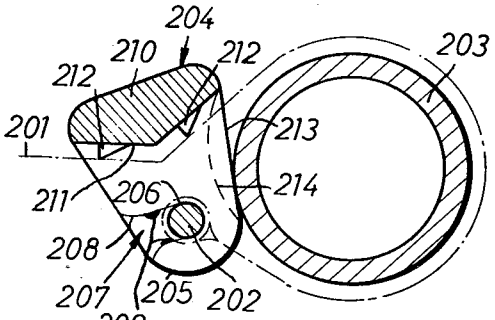
FIG. 23 shows a broken away cross section through a frame member of a piece of furniture with an end of the strip element of another frame covering according to the invention secured thereto.

Another frame covering, again consisting of flat strips 201 extending parallel to one another, is provided with means for fastening the ends of the strips 201 to the sides 203 of the frame as shown in FIGS. 23 to 26. Only one of the fastening means is illustrated in FIGS. 23, 25 and 26. The said means has a transverse pin 202, for example of metal, connected to the strip and which can be taken round the frame sides 203 of the frame and secured to the strip 201 itself by means of a clasp 204.

The clasp 204 can be placed astride the strip 201 leading to the frame strut and comprises connecting arms 205 to which the ends of the transverse pin 202 of the end of the strip taken round the frame strut 203 can be locked. FIG. 23 shows the end position of all the parts.

The arms 205 of the clasp 204 have aligned, oppositely-facing pin receiving pockets 206 for the ends of the transverse pin 202. Associated with each of the receiving pockets 206 is a slot or channel 207 connecting arms 205, the purpose of channels 207 being to allow the ends of the pin 202 to be introduced into the pocket 206. Each introductory slot 207 has at its outer end remote from the receiving pocket 206, a funnel-shaped entry 208 which facilitates insertion of the end of the transverse pin 202 into the pocket. The said slot also has a constriction formed by detents 209 which prevents inadvertent outward movement of the inserted pin end from the pocket. At the constriction, the channel width is less than the diameter of the end of the pin 202.

The receiving pockets 206 and the channel 207 are formed as recesses in the inside faces of the connecting arms 205, the outside faces of the connecting arms 205 presenting a surface free from openings.

The clasp 204, which is preferably an injection-moulded plastics member, has a centre arm 210 linking arms 205. Arm 210 has an inside 211 adjacent to the strip 201 which has an obtuse-angled cross-sectional outline projecting towards the strip (see FIG. 23). The inside 211 could instead have a concave rounding curving towards the strip 201. The inside 211 of the centre arm 210 of the clasp 204 comprises an antislip surface shape, to prevent the strip 201 from slipping through from left to right as viewed in FIG. 23 after being fitted to frame side 203. In the example illustrated, the inside 211 of the centre arm 210 of the clasp 204 is provided with inwardly projecting ribs or teeth 212, which are aligned transversely to the longitudinal direction of the strip and are substantially triangular in cross-section. The ribs 212 which provide anti-slip characteristics extend over at least a portion of the width of the strip. The ribs could be constructed in the form of dog-like projections. As can be seen from FIG. 23, the angling of the triangular ribs 212 is such that the rib surfaces adjacent to the main portion of the strip 201 are aligned substantially perpendicular to the surface of the strip.

The clasp 204 illustrated in full lines has a symmetrical shape and the connecting arms 205 are of U-shape when viewed from the side. After the fitting of a strip 211 in the manner illustrated in FIG. 23, the clasp 204 adopts the position illustrated, under the tension in the strip 201, in which position it extends with its centre arm 210 parallel to the frame side 203 and transversely to the longitudinal direction of the strip. In a modification of the embodiment illustrated, the side 213 of the connecting arm 205 adjacent to the frame side 203 may comprise an arcuate hollow 214 adapted to the outside contours of the frame side 203. A clasp when so constructed will, in use, lie close to the frame side 203 and bearing thereagainst, thus achieving self-alignment with respect to side 203.

The transverse pin 202 is disposed in a holding loop 215 at the end of the strip 201 and is preferably located in the loop when this is formed. Alternatively, the transverse pin can, however, be received in a widened loop if transverse pins 202 and strips 201 are to form parts independent of one another. The location of the transverse pins 202 in the strips has the advantage of facilitating handling.

The transverse pin 202 could be connected to the end of strip 201 in other ways. One possibility is to embed it, e.g. by fusing into a thickened portion of the end of the strip.

Here, too, the strips preferably consist of extruded and stretched plastics material, for example high-pressure or low-pressure polyethylene, polypropylene, polyester, or polyamide. They may be reinforced, for example with glass filaments or the like.

In order to anchor a strip 201 on a frame side 203, the end of the strip provided with the transverse pin 202 is taken round the frame strut 203, the clasp 204 is placed on the strip 201 close to the frame strut 203 and then the transverse pin 202 is inserted with its ends projecting beyond both edges of the strip 201 into the receiving pockets 206 of the connecting arms.

The lattice-like or net-like frame cover can be used for beds or the seats or backs of chairs and couches of conventional furniture or furniture intended for use outdoors such as when camping.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. A filament strip support for furniture intended to be sat, lain or reclined on, comprising an array of filaments which extends in one longitudinal direction, thereby to form a filament strip support construction, attachment means for securing said filaments at their free ends to a frame of a piece of furniture, each of said filaments being in the form of a flat strip, and each of said filaments being connectable to a part of said frame by passing an end of said strip around said frame part to form a frame encircling loop, and securing said end to the strip itself by means of a securing member adapted to grasp said strip and constituting one of said attachment means, said securing member is in the form of a clasp to be placed astride the said strip, said attachment means further includes a separate transverse locking member, said clasp having a pair of arms for holding the ends of said locking member, the latter being secured to the end of said strip.

2. A support as claimed in claim 1, wherein said arms of the clasp have opposed, aligned receiving pockets adapted to receive therein the ends of said transverse locking member.

3. A support as claimed in claim 2, wherein each of the receiving pockets has an introductory slot for the ends of the locking member, the slots extending away from the end of said strip when the latter is in its secured position on said frame.

4. A support as claimed in claim 3, wherein there is means to prevent an outward displacing movement of an inserted end of the transverse locking member from said pockets provided in each introductory slot.

5. A support as claimed in claim 3, wherein each introductory slot has a funnel-shaped entry portion remote from the associated pocket to facilitate insertion of the ends of the transverse locking member into said slots.

6. A support as claimed in claim 3, wherein said displacement-preventing means is formed by constrictions in said introductory slots, said constrictions having widths less than the corresponding widths of the ends of said transverse locking member.

7. A support as claimed in claim 1, wherein said receiving pockets and said introductory slots are in the form of recesses in the confronting inside surfaces of the said arms of the clasp.

8. A support as claimed in claim 1, wherein said clasp is U-shaped, the arms forming the libs of the U, and the base of the U has a strip-confronting surface which in a cross-sectional outline projects at an obtuse angle towards the strip.

9. A support as claimed in claim 1, wherein said clasp is U-shaped, the arms forming the limbs of the U, and the base of the U having a strip-confronting surface which comprises at least two surfaces angled towards the strip.

10. A support as claimed in claim 1, wherein the said two surfaces are furnished with projections to prevent relative slipping between said strip and said clasp.

11. A support as claimed in claim 10, wherein said projections are inwardly projecting ribs aligned transversely to the longitudinal direction of the strip and which are substantially triangular in cross-section, said ribs extending over at least a portion of the region of the strip width.

12. A support as claimed in claim 1, wherein said arms have edges adapted to the external contour of said frame to permit said arms to bear snugly thereagainst.

13. A support as claimed in claim 1, wherein the transverse locking member is received in a folded-over holding loop at the end of said strip.

14. A support as claimed in claim 1, wherein the transverse locking member is embedded in a thickened portion of the end of the strip.

15. A support as claimed in claim 1, wherein said clasp is an injection-moulded plastics member.

16. A support according to claim 1, wherein the filaments of each array thereof are disposed parallel to one another.

* * * * *